United States Patent [19]

Harding

[11] 4,269,547

[45] May 26, 1981

[54] TUNNEL ROOF SUPPORTING APPARATUS

[76] Inventor: John D. Harding, 8 Field Close, Gedling, England

[21] Appl. No.: 41,401

[22] Filed: May 21, 1979

[30] Foreign Application Priority Data

May 25, 1978 [GB] United Kingdom ..... 22588/78

[51] Int. Cl.[3] ..... E21D 15/582; E21D 15/58

[52] U.S. Cl. ..... 405/303

[58] Field of Search ..... 405/146, 151, 288, 303, 405/291-301; 248/356

[56] References Cited

U.S. PATENT DOCUMENTS

| | | | |
|---|---|---|---|
| 1,382,668 | 6/1921 | O'Rourke | 405/146 X |
| 3,678,694 | 7/1972 | Haspert | 405/146 |
| 4,075,856 | 2/1978 | Sigott et al. | 405/288 |

FOREIGN PATENT DOCUMENTS

| | | | |
|---|---|---|---|
| 2704222 | 8/1978 | Fed. Rep. of Germany | 405/151 |
| 1488579 | 6/1967 | France | 405/146 |
| 1549192 | 7/1979 | United Kingdom | 405/146 |

*Primary Examiner*—Dennis L. Taylor

*Attorney, Agent, or Firm*—Michael J. Striker

[57] ABSTRACT

The invention relates to a self-advancing roof supporting apparatus for providing temporary support of a portion of the roof of a tunnel, for example in an underground mine such as a coal mine. When tunnels are being extended, temporary roof supports need to be erected while the newly excavated material is removed and permanent roof supports installed.

The apparatus of the invention has means engageable upon the permanent roof-supports to suspend the apparatus therefrom, and preferably has two relatively slidable gripping devices (5) or sets of devices to enable the apparatus to be advanced or withdrawn along the tunnel.

18 Claims, 2 Drawing Figures

TUNNEL ROOF SUPPORTING APPARATUS

Figures 1, 2:
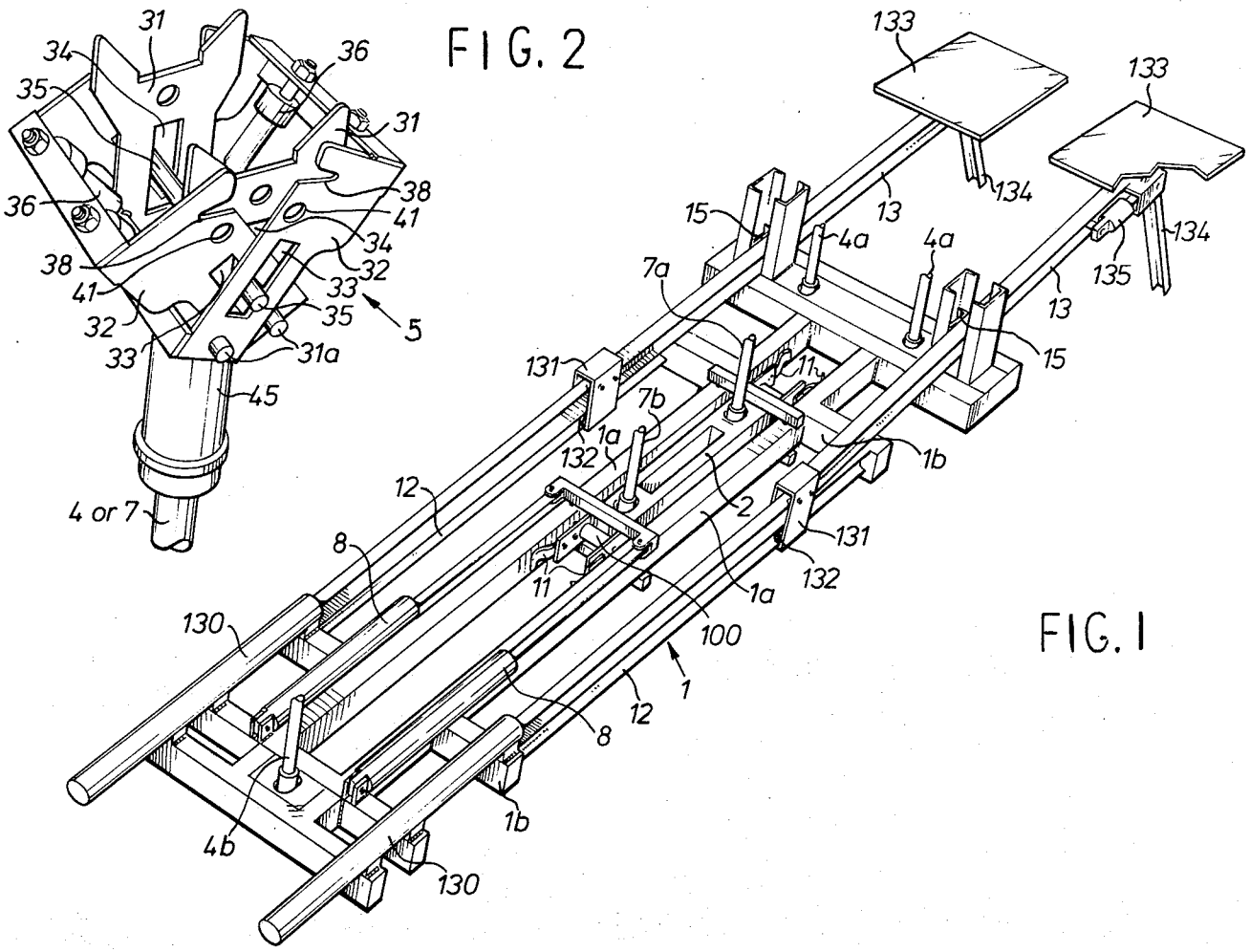

This invention relates to a self-advancing roof supporting apparatus for providing temporary support of a portion of the roof of a tunnel, for example such as a coal mine.

Tunnels in a coal mine, for example the roadways at each end of a coalface, known as gates, may be extended as the face advances by excavating rock, providing a support beneath the newly excavated roof, and then removing the loose material.

The roof supports in each gate generally take the form of a rectangular or arched frame formed from steel girders of the I-beam type. When the gate is to be extended and rock has been blasted, for example, the fresh roof section is supported by attaching girder supports to two or more of the leading roof supports in the gate and sliding girders forward over the girder supports until the girders extend beneath the fresh roof section. The space between the girders and the roof is packed with wood or steel blocks or bars so that the roof is supported in cantilever fashion by the girders. The debris is then removed and more permanent roof supports installed. This procedure is very hazardous and fatalities have often occurred.

One aspect of the present invention provides a self-advancing roof-supporting apparatus for providing temporary support of a portion of the roof of a tunnel having spaced roof-support members therein, the apparatus having means engageable upon the roof-support members whereby in use the apparatus may be suspended from said members.

The apparatus may comprise a main frame having a fixed gripping device and a movable gripping device which may slide longitudinally relative to the frame, the gripping devices being arranged selectively to grip the roof supports. Preferably two or more fixed gripping devices and two or more movable gripping devices are provided. This arrangement of fixed and movable gripping devices enables the apparatus to be advanced relative to the roof supports, by suspending the main frame from one or more roof supports by the fixed gripping devices or devices, advancing the movable gripping device or devices until it or they can grip the next roof support or supports, releasing the fixed gripping device or devices and advancing the main frame relative to the movable gripping device or devices until the fixed gripping device or devices can grip another of the permanent roof supports in the gate, and repeating the cycle as necessary.

The apparatus may have one or more roof supporting beams, which may be supported on the main frame and may be extendable forward thereof and retractable, preferably by means of hydraulic rams. Hydraulic rams, or any other suitable lifting means, may also be provided to lift at least a part of the or each supporting beam relative to the main frame.

The gripping devices may be any suitable remotely engageable and releasable clamp, preferably adapted to grip girders of the I-beam type. The gripping devices are suitably mounted at the upper ends of vertically-arranged hydraulic rams so as to be liftable up into engagement with the roof supports.

A preferred form of gripping device comprises a pair of arms each pivotally mounted at one end thereof on a respective fixed pivot, the arms crossing each other, and a common movable pivot being provided between the two arms such that movement of the movable pivot away from the two fixed pivots tends to force the two free ends of the arm towards each other.

Preferably means such as springs or hydraulic cylinders are provided to draw the free ends apart when the movable pivot is allowed to move towards the fixed pivots. When the device is mounted at the end of the ram, for example, the end of the ram may be secured to the movable pivot and a fixed guide plate may be provided to engage the girder, further upward movement of the ram thus causing the arms to grip the beam. Locking means may be provided to hold the arms in this position, for additional safety.

Reference is now made to the accompanying drawing, in which:

FIG. 1 shows a perspective view of apparatus according to one aspect of the invention; and FIG. 2 shows an enlarged perspective view of a gripping device forming part of the apparatus shown in FIG. 1.

The apparatus comprises a main frame 1 in which is slidably mounted a slide frame 2. Two fixed vertical hydraulic rams 4*a*, each bearing a gripping device 5 (FIG. 2), are secured at the forward end of the main frame 1, and a third fixed vertical hydraulic ram 4*b* is secured adjacent to the rear end of the apparatus. The rams 4, although nominally fixed, are resiliently mounted to allow for uneven spacing of the roof supports.

Two movable hydraulic rams 7 are resiliently mounted on the slide frame 2. These movable rams 7 are also provided with gripping devices 5 at their uppermost ends. The slide frame 2 is driven along the main frame 1 by two horizontal hydraulic rams 8, the resilience of the ram mountings allowing relative movement of the rams 7 to accommodate uneven spacing of the roof supports. The slide frame 2 is carried by single ball bearings and is dimensional so as to allow lateral and slight rotational movement relative to the main frame. Strong leaf springs 11 are mounted at each end of the slide frame 2, the springs bearing against the inner longitudinal beams 1*a* of the main frame to hold the slide frame central to the main frame. A double-acting transverse hydraulic ram 100 at each end of the slide frame serves to achieve lateral or rotational deflection of the slide frame 2, permitting the apparatus to be worked around bends in the gate, for example.

Side rails 12, having double channel or I-beam section, are secured between two of the inner cross beams 1*b* of the main frame 1 on each side of the apparatus and two roof supporting beams 13 are each pivotally mounted at one end thereof in a carriage 131 having rollers 132 which run in the channels of the side rails 12 to guide and support the beam 13 when it is slid relative to the apparatus. Each beam 13 is supported adjacent to the forward or leading end of the apparatus by lifting guide wheels (not shown) mounted in a cradle 15 on the end of a hydraulic lifting ram (not shown) and running the channels in the I-beam 13. Rams 130 are provided on the main frame 1 to advance and retract the beams 13 relative to the main frame. The rams 130 are connected to the carriages 131.

The beams 13 each have a roof-support plate 133 pivotally mounted at the free end thereof to increase the area of support provided by the beams. In addition each beam 13 has a lip-support arm 134 pivotally mounted thereon beneath the plate 133 and pivotable by means of a hydraulic ram 135. The arms 134 serve to support the lip of cut rock between the seam height and the greater roadway or gate height.

In use, the apparatus starts from a position wherein it is suspended from roof supports in a gate of a mine by the gripping devices 5 on the fixed rams 4. The gripping devices 5 on the movable rams 7 are retracted and the slide frame 2 is slid forward by means of rams 8 until the forward ram 7*a* lies beneath the next roof support girder. The ram is then extended and the gripping device engaged with the girder. If the spacing between the girder and the next girder behind it is correct the rear ram 7*b* may also be extended, but if the rear ram 7*b* is not correctly placed with respect to the girder, its position will be adjusted by virtue of its resilient mounting.

When the gripping devices 5 on both rams 7 are engaged, those on the fixed rams 4 are disengaged and withdrawn downwardly, and the apparatus may then be advanced by retracting the horizontal rams 8 until the gripping device 5 on the forward fixed ram 4*a* is aligned with the next forward roof support girder. The device 5 is then lifted into engagement with the girder and the rear fixed ram 4*b* can then be extended and the gripping device attached thereto engaged upon the girder. The movable rams 7 may then be retracted and the cycle may be repeated.

At the desired position adjacent to the newly-blasted section of the gate, the roof-supporting beams 13 are advanced beneath the unsupported roof of the gate using the rams 130. The lifting rams are then operated to engage the roof-supporting plates 133 with the new roof section of the gate. If desired, additional cross supporting beams may be positioned across the beams 13 and against the roof. The gate may then be cleared prior to installing permanent roof supports.

The gripping device shown in FIG. 2 comprises two side plates 31 shaped at one end to locate upon, for example, the lower flange of an I-beam girder. A pair of crossed arms 32 is pivotally mounted at each plate 31 on fixed pivots 31*a*, each arm 32 having therein at the point of overlap a slot 33 extending longitudinally of the arm. A vertical slot 34 is provided in each side plate 31, and a movable pivot rod 35 passes through all the slots. The arms 32 are biased to an open position, by means of helical springs enclosed in telescopic covers 36.

Each arm 32 has at one end a cut-out 38 arranged to engage a roof support girder in the gate, for example on the lower flange of an I-beam. A hole 41, through which a locking pin may pass, is provided in each arm 32. The pin is driven by a hydraulic locking cylinder (not shown), and locks the arms together in the closed position, engaged upon the roof support girder.

The device is mounted on the end of a hydraulic ram 4 or 7 by means of a swivel or universal mount (not shown) on the movable pivot rod 35, permitting displacment of the device to align with the roof support girders. Rotation of the device relative to the ram 4 or 7 is corrected by means of a two-part collar 45 mounted around the ram. The collar 45 is split obliquely to the axis thereof so that when the two parts are brought together the device is forced into correct radial alignment.

In use, the ram 4 or 7 is extended until the side plates 31 locate upon the lower flange of the roof-support girder. Further extension of the ram 4 or 7 causes the movable pivot rod 35 to move upwardly, relative to the side plates 31, in the slots 34, thus drawing the arms 32 inwardly towards each other until the cut-outs 38 engage the flange of the girder and the holes 41 are aligned. The locking cylinder is then operated to push the locking bolt through the holes 41 to lock the arms 32 in engagement with the girder.

Release of the device from the girder is the reverse of the procedure described, the springs 36 serving to draw the arms apart towards the open position.

The gripping device permits a girder, for example, to be positively gripped without the need for separate means to close the arms to the gripping position. it is relatively simple to construct and operate.

I claim:

1. Self-advancing roof-supporting apparatus for providing temporary support of a portion of the roof of a tunnel having spaced roof-support members therein, comprising a main frame; and means engageable with the roof-support members for suspending the apparatus therefrom, said means comprising at least one fixed gripping device and at least one movable gripping device slidable longitudinally of said frame, said gripping devices being arranged to selectively grip the roof-suppport members and at least one vertical hydraulic ram on which one of said gripping devices is mounted so as to be urged upwardly into engagement with the roof-support members.

2. Self-advancing roof-supporting apparatus for providing temporary support of a portion of the roof of a tunnel having spaced roof-support members therein, comprising a main frame; and means engageable with the roof-support members for suspending the apparatus therefrom, said means comprising at least one fixed gripping device and at least one movable gripping device slidable longitudinally of said frame, said gripping devices being arranged to selectively grip the roof-support members, and at least one hydraulic ram on which one of said gripping devices is mounted so as to be urged into engagement with the roof-support members.

3. Apparatus to claim 2, comprising two or more fixed gripping devices and two or more movable gripping devices.

4. Apparatus according to claim 2, wherein the or each gripping device comprises a pair of arms each pivotally mounted at one end thereof on a respective fixed pivot, the arms crossing each other, and a common movable pivot being provided between the two arms such that movement of the movable pivot away from the two fixed pivots tends to force the free ends of the two arms towards each other.

5. Apparatus according to claim 4, wherein biasing means are provided to urge the free ends of the two arms away from each other.

6. Apparatus according to claim 5, wherein the biasing means comprises helical springs under tension.

7. Apparatus according to claim 5, wherein the biasing means comprises a hydraulic ram.

8. Apparatus according to claim 4, wherein locking means are provided selectively to lock the arms in engagement with the roof-support members.

9. Apparatus according to claim 8, wherein the locking means comprises a bolt insertable into aligned holes in the arms.

10. Apparatus according to claim 9, wherein the bolt is hydraulically operable.

11. Apparatus according to claim 2, wherein the or each gripping device includes a guide plate presenting a tapering mouth for guiding the device into alignment with a roof-support member upon which the device is to be engaged.

12. Apparatus according to claim 2, wherein the or each gripping device is rotatably mounted relative to the main frame.

13. Apparatus according to claim 2, comprising one or more roof-supporting beams supported by the main frame and movable longitudinally thereof so as to form a cantilever forward of the frame.

14. Apparatus according to claim 13, wherein the or each roof-supporting beam is mounted on a pivot slidable along the main frame, whereby the free end of the beam may be elevated relative to the frame.

15. Apparatus according to claim 13, wherein an extension member is pivotally mounted on the free end of the or each roof-supporting beam and is rotated relative to said beam by means of a hydraulic ram.

16. Self-advancing roof-supporting apparatus for providing temporary support of a portion of the roof of a tunnel having spaced roof-support members therein, comprising a main frame; a slide frame slidably mounted on said main frame; and means engageable with the roof-support members for suspending the apparatus therefrom, said means comprising at least one fixed gripping device, at least two movable gripping devices, and resilient mountings which mount said movable gripping devices on said slide frame, whereby the spacing between the gripping devices may be varied to permit engagement of longitudinally spaced gripping devices on adjacent roof-support members which are spaced at non-standard intervals.

17. Apparatus according to claim 16, wherein the slide frame is slidable relative to the main frame by means of a longitudinal hydraulic ram on the main frame.

18. Self-advancing roof-supporting apparatus for providing temporary support of a portion of the roof of a tunnel having spaced roof-support members therein, comprising a main frame; a slide frame slidably mounted on said main frame and also being mounted to be rotatable relative thereto; means engageable with the roof-support members for suspending the apparatus therefrom, said means comprising at least one fixed gripping device, and at least one movable gripping device mounted on said slide frame; and a hydraulic ram mounted on said slide frame and acting upon said main frame so as to rotate the slide frame relative to the main frame.

* * * * *